US006234250B1

(12) United States Patent
Green et al.

(10) Patent No.: US 6,234,250 B1
(45) Date of Patent: May 22, 2001

(54) REAL TIME WELLBORE PIT VOLUME MONITORING SYSTEM AND METHOD

(75) Inventors: Matthew Daryl Green; David Power; Jae Song, all of Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/360,866

(22) Filed: Jul. 23, 1999

(51) Int. Cl.[7] ..... E21B 47/00

(52) U.S. Cl. ..... 166/250.03; 175/65; 175/207; 73/152.21; 73/152.31; 73/152.62

(58) Field of Search ..... 166/250.03, 250.01, 166/65.1, 66, 75.11; 175/65, 207, 213; 73/152.21, 152.31, 152.62

(56) References Cited

U.S. PATENT DOCUMENTS 4,043,193 * 8/1977 Bailey ..... 73/155
5,952,569 * 9/1999 Jervis et al. ..... 73/152.01

OTHER PUBLICATIONS

George Haines: "Driller–Friendly Kick Detector Responds to Small Volume Kicks," Drilling Technology, Jul. 1998, pp. 37–39.

H.K. Johnsen et al: "Development and Field Testing of a High–Accuracy Full–Bore Return Flow Meter," IADC/SPE, Feb. 28–Mar. 2, 1998, pp. 435–444.

O. G. Steine: "Full Scale Kick Detention System Testing Relevant for Slim–Hole/HPHT Drilling," SPE 30449, Oct. 22–25, 1995, pp. 9–24.

D.M. Schafer: "An Evaluation of Flowmeters for the Detection of Kicks and Lost Circulation During Drilling," IADC/SPE 23935, Feb. 18–21, 1992, pp. 783–792.

* cited by examiner

*Primary Examiner*—Roger Schoeppel
(74) *Attorney, Agent, or Firm*—Browning Bushman

(57) ABSTRACT

A system is provided for monitoring in the real time the wellbore pit volume to promptly determine the occurrence of a wellbore kick and take corrective action to minimize fluid influx volume and/or drilling fluid losses. A system includes one or more level sensors 22 which output signals to a pit volume totalizer 20 and then to a computer 26. Computer 26 may also receive signals from one or more fluid temperature sensors 40 and one or more fluid compressibility sensors 42. The output from the computer may be displayed in real time in various monitors 28, then also may be output to a permanent record 30. Computer 36 may also automatically activate the conventional alarm 32 to alert the drilling operator to the occurrence of a kick. Substantial savings in drilling time and cost may be realized according to the present invention, along with benefits of reduced environmental contamination and enhanced well safety.

24 Claims, 6 Drawing Sheets

REAL TIME WELLBORE PIT VOLUME MONITORING SYSTEM AND METHOD

FIELD OF THE INVENTION

The present invention relates to equipment and techniques for monitoring wellbore drilling fluid during the make-up of oil field tubular connections. More particularly, the present invention relates to a real-time wellbore pit volume monitoring system for providing timely information to the driller with respect to wellbore characteristics such as wellbore breathing and kick detection.

BACKGROUND OF THE INVENTION

Wells associated with the recovery of hydrocarbons are drilled in stages or intervals. At the end of an interval, a steel casing is placed in the hole to support the formation and prevent the drilled hole from collapsing. After a string of casing of one nominal size is placed in the well, a lower interval of the well is drilled with a slightly smaller diameter, and so on. To drill the well, the drilling fluid is circulated from the surface down through the inside of the drill pipe and, up the annulus between the drill pipe and the well bore and thus back to the surface. The circulating fluid carries the drill cuttings to the surface, and serves lubricating and other purposes well recognized by those skilled in the industry. The circulating fluid thus allows the well hole to be efficiently drilled.

The most economical recovery of hydrocarbons maximizes the useful information available to a drilling operator while that operator is making up tubular connections and lowering the drill string into the wellbore. Prior art systems include designs intended to detect "kicks" while drilling a well, and this information is vital to the safety of the drilling operation. A kick is an uncontrolled flow of fluid into the wellbore from the subterranean formation, and typically results from drilling into a zone of higher than expected or unanticipated pressure. Kicks are thus both dangerous and very costly to drillers, and accordingly drilling operators inherently wish to avoid or minimize kicks, or at least detect kicks as early as possible. The early detection of kicks is particularly important in deep water drilling operations. At times kicks may be confused with wellbore breathing, which is a less dangerous phenomenon associated with drilling a well. Wellbore breathing is also referred to by those skilled in the art as wellbore ballooning. As used herein, "wellbore breathing" includes traditionally recognized wellbore breathing and the characteristic sometimes referred to as wellbore ballooning. Wellbore breathing can occur in certain formations and is characterized by the phenomena where fluid is lost to the formation while drilling, then when the pumps are turned off, the fluid subsequently returns to the wellbore. It is important to appreciate that the preferred response by the driller when encountering a kick is almost exactly opposite to the response when encountering wellbore breathing, although only those skilled in the art fully appreciate the significant difference. Accordingly, it is essential that kicks not be interpreted as wellbore breathing and vice-versa. If misdiagnosed, the wrong response will be applied, which will promote rather than cure the problem.

In the absence of a kick, the volume of fluid (excluding minor amounts attributable to drill cuttings and filtration into porous rock) that is pumped into the hole should equal a volume that flows out of the hole, provided that fluid is not being lost to the downhole formation. Drilling mud "pits" are surface reservoirs that the drilling fluid is drawn from and returned to. By monitoring the pit volume, the drilling operator is able to determine any differential or additional flow of drilling fluid from the well. When the pumped circulation of the drilling fluid is stopped, the observed flow out of the well may continue for a short period of time even though the mud pumps are deactivated. Thus the fluid level in the pits may increase for a short period of time once flow is stopped. This information may be misinterpreted as a kick when well bore breathing in fact is occurring, or the information may in fact provide a rapid indication of a kick.

There are two primary types of existing systems for early detection of kicks. One system, which is commonly referred to as the delta-flow method, compares the rate of flow into the well in the drill string to the rate of flow out of the well. An example of the instrumentation commonly used in this delta-flow method is a J-meter. The instrumentation needed to perform early kick detection using the delta-flow method may be both complex, cumbersome and difficult to maintain. Moreover, many variations of this delta-flow method cannot be reliably used on all commonly used drilling fluids since they rely on measured flow rate or measured fluid momentum.

The other commonly used early kick detection method is commonly referred to as the acoustic method. The acoustic method detects density differences in the fluid returning to the surface. The acoustic method typically is not able to reliably detect a water kick since the system inherently relies upon measurement of a significant density difference of the fluid exiting the well compared to the density of the fluid entering the well. In the acoustic method, there is also a lag time between the influx occurring and the detection of the density change on surface. Both the acoustic and the delta-flow methods may be costly.

Prior systems that disclose that the delta-flow methods and/or acoustic method for early kick detection are discussed in the following publications;

1. IADC/SPE 17228, Johnson H. K., "Development and field testing of a High-Accuracy Full-Bore Return Flow Meter";
2. IADC/SPE 23935, Schafer D. M. et al., "An Evaluation of Flowmeters For the Detection of Kicks and Lost Circulation During Drilling";
3. SPE 30449, Steine O. G., Rommetveit R., "Full Scale Kick Detection System Testing Relevant for Slim-Hole/HPHT Drilling";
4. Haines G., Desloovere O. "Driller-Friendly Kick Detector Responds to Small Volume Kicks," Petroleum Engineer International, July 1998.

Prior art techniques also include a method involving visual flow estimation. This technique may provide an indication of an incoming kick. This technique characterizes the flow as "five finger" or full flow, scaling down to no flow (no fingers). This is simply a visual observation made by a member of the drilling crew, and no accurate assessment of the flow rate is possible since the information is simply conveyed in the driller through vocal communication. No baseline data is generated for comparison with the real time data, and real time data is not recorded.

The disadvantages of the prior art are overcome by the present invention. A new technique is disclosed for detecting properties affecting the well and/or the well fluid while drilling. The techniques of the present invention do not have the disadvantages of the prior art systems, and in fact promote a markedly different approach to detect kicks and more reliably distinguish a kick from wellbore breathing.

SUMMARY OF THE INVENTION

The present invention involves equipment and methods to generate data at the rig site and will be able to measure, record, and display the relevant data in a manner which will reliably and rapidly detect kicks in a well, and equally important will be able to reliably distinguish between a kick and wellbore breathing. In a more general sense, the techniques of the present invention may be used to reliably predict and determine various down-hole behaviors relating to the drilling fluid and the wellbore while drilling the well. A particular feature of the present invention is that the techniques reliably provide an indication of down-hole behavior of the drilling fluid in real-time, i.e. substantially instantaneously with the detected change in the measured parameters.

In a preferred embodiment of the present invention, the real-time graphical display of information provides the drilling operator with a direct comparison of the flow-back profile compared with previously generated flow-back profiles, thus allowing any formation fluid influx representative of a kick to be quickly detected. Well control decisions may thus be quickly and reliably made, and wellbore breathing may be quantified and distinguished from a kick. If wellbore breathing is present, "stable" drilling may resume sooner than would otherwise be the case using prior art techniques, thereby saving valuable rig time.

A preferred embodiment of the invention, the well flow rate may be monitored when the pumped drilling fluid flow rate going into the well is zero. The total pit volume is logged by computer software and is thereby recorded. The difference between this starting total pit volume and the actual current pit volume with the pump off may then be plotted as a function of time. When the pumps are turned back on, the plot may be stopped. A flow-back profile is thus recorded. The flow-back profile may be superimposed on previously recorded profiles to enable easy comparison. If the current trend differs from historical profiles, the information provided indicates that there is a potential problem and appropriate action may thus be promptly taken.

It is an object of the present invention to provide a system which will monitor the pit volume change with the pumps off and compare the current pit volume change in real time with that observed on previous occasions when the pumps were turned off, thereby allowing the characterization of wellbore breathing (if present) and the rapid detection of any formation fluid influx or "kick". If wellbore breathing is present and monitoring indicates that the well is stable, drilling may resume sooner than otherwise would be the case. If the system detects a formation fluid influx or kick, the well may be shut-in more promptly than using many of the prior art techniques. In a preferred embodiment, a comparison between the current pit volume and the previous recorded pit volume may be graphically displayed to the drilling operator in real time. Alternatively, information may otherwise be provided to the drilling operator, and systems may be employed to automate the response to this information, thereby reducing the subjectivity of the drilling operator or the reaction to the sensed data.

In a preferred embodiment, the system of the present invention utilizes instrumentation that includes a Pit Volume Totalizer (PVT) that constantly measures the volume of drilling fluid in the storage pits adjacent the rig. PVT instrumentation provides an output of the volume of drilling fluid in the pits in real-time. Selected procedures are used to generate baseline information under controlled and well defined circumstances. With this baseline information, the effectiveness of the invention is significantly increased. The baseline data are thus considered essential to the effective implementation of the invention. When there is an irregular increase in the volume, a kick is suspected. The PVT's may thus be linked to a data recorder and a computer which then allow the display of real-time and recorded data for comparison purposes. The real-time data may be linked to an alarm that notifies the operator of an abnormal increase in the pit volume.

Baseline data (i.e. the recorded volume verses time flow out of the well when the pumps are shut down) is preferredly generated immediately prior to commencing the next drilling interval. Drilling fluid is circulated within a cased interval of the hole at the rate to be used when drilling that interval. The pumps may then be shut down and the flow out of the well recorded. Using this technique, all the contributing factors to a continuing flow when the pumps are shut down are known and may thus be quantified. Once drilling starts, the level of confidence with respect to correctly identifying the contributing factors to flow out of the well is significantly increased. If the real-time volume flow curve is substantially different from the flow curve under controlled circumstances (baseline data), then the driller is able to much better identify the situation and determine if a kick is occurring or is likely to occur.

These and further objects, features, and advantages of the present invention will be apparent from the following description of presently preferred embodiments, given for the purpose of disclosure and taken in conjunction with the accompanying drawings.

DETAILED DESCRIPTION OF PREFERRED EMBODIMENTS

Figure 1:
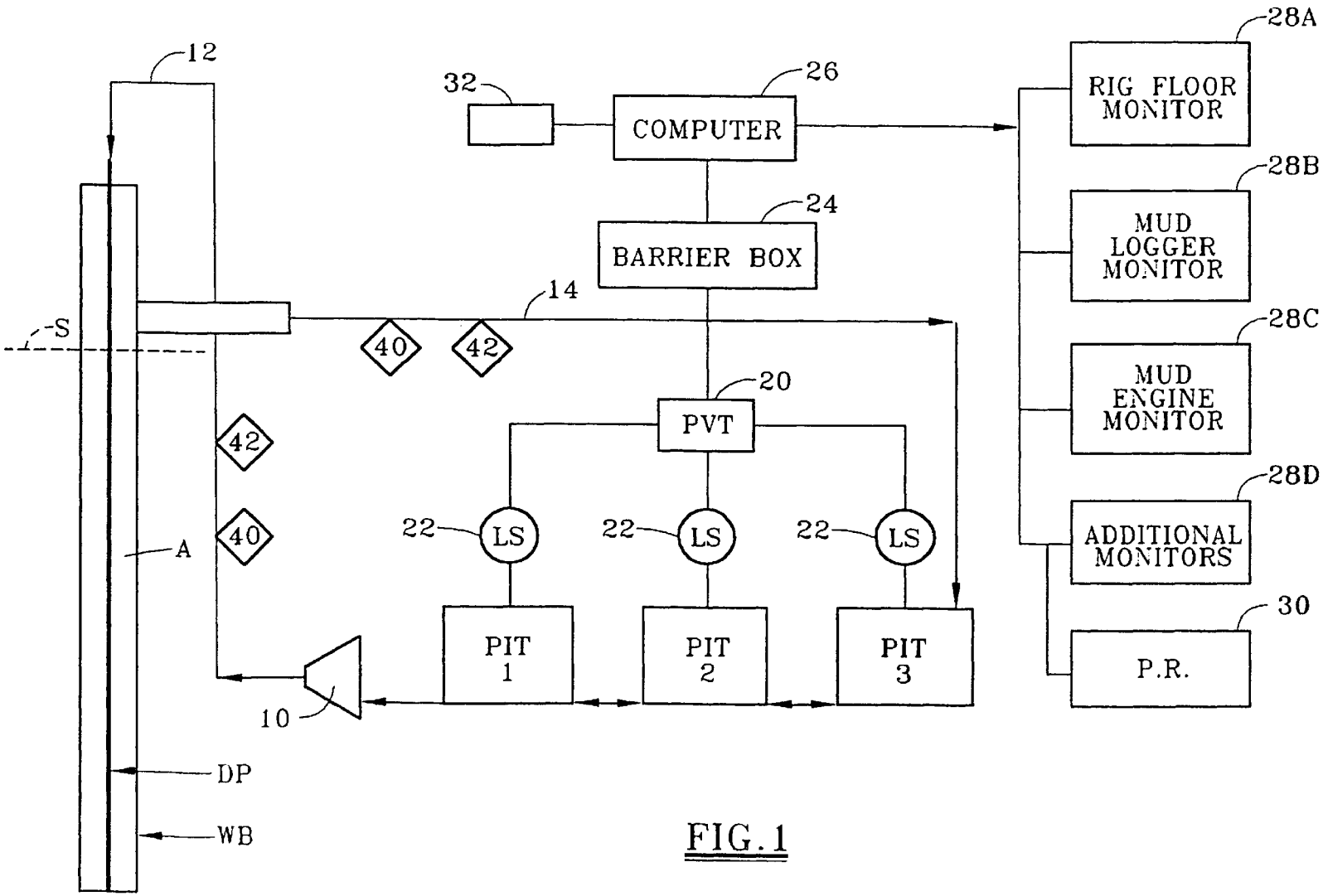
FIG. 1 is a simplified schematic view of primary components of a real-time wellbore pit volume monitoring system according to the present invention.

FIG. 1 schematically illustrates one embodiment of the present invention. Wellbore WB contains a conventional drill pipe DP extending from the surface S to the lower end of the wellbore. FIG. 1 illustrates these active mud pits P1, P2, and P3 fluidly connected in series. One or more mud pump 10 pump mud from the pits through the fill line 12 and into the interior of the drill pipe DP. The pumped fluid is then pushed upward through the annulus A surrounding the drill pipe DP. Fluid returning to the surface passes through mud return line 14 via various surface equipment components (not shown) as known to those skilled in the art, and then into the mud pits, thereby completing the closed loop. Those skilled in the art will understand that any number of mud pits may be provided. Typically six or more mud pits of various sizes are located at the surface of most wells, but at any one time all mud pits are not necessarily "active", i.e., contributing volume to the closed loop system of the circulating mud going into the wellbore WB and returning to the surface S.

A pit volume totalizer 20 receives an electrical signal from respective fluid level sensors 22, and outputs a current signal to a barrier box 24. The barrier box 24 converts the current signal from the pit volume totalizer to a computer literate signal, and is also capable of permanent recording all data from the pit volume totalizer 20. Barrier box 24, pit volume totalizer 20, and the one or more level sensors 22 are standard existing components available on many modern drilling rigs. Pit volume totalizer 20 thus only monitors the volume of the "active" pits. Data has previously been generated by similar components on the rig, but that generated data were not used for the purposes of the present invention. Because no analysis or detailed use of the real time data generated from these meters is currently undertaken (even if this information were to be used for kick detection) the kick detection is often significantly delayed and is thus damaging to the well. In many instances, the loss of the interval being drilled can result, as well as an unsafe drilling environment.

The output from the barrier bit 24 is input to a computer 26, and may then be output to a rig floor monitor 28A, a mud logger monitor 28B, a mud engineer monitor 28C, any additional monitor 28D, and a permanent record 30. Although permanent record 30 may output a conventional paper printout, those skilled in the art will understand that the permanent record may be stored on any number of suitable data storing and retrieving devices. Computer 26 contains the software necessary to handle the data and convert the data to the display format desired. As explained further below, computer 26 may also receive signals from one or more thermal sensors 40 each responsive to the temperature of the drilling fluid in a closed loop system, and also from one or more pressure and/or density (fluid compressibility) sensors 42 each responsive to the compressibility of the fluid in the closed loop system. Computer 26, monitors 28, and the permanent record 30 may thus be equipment which is brought to the rig site for the purposes discussed herein. The computer 26 may activate an audible and/or visual alarm 32 to alert the drilling operator of a potential problem. Alternatively, the output from the pit volume totalizer 20 could be input to a preexisting computer and could be output to a preexisting monitor, as discussed subsequently.

Mud flows from the pits P into the wellbore WB at a flow rate Q(in), and mud flows out of wellbore WB and back to the pits P at a flow rate Q(out). The mud flowing into the well has a determinable density D(in), while the mud flowing out of the well has measured density D(out). The delta flow method for determining kick relies upon the concept of Q(out) being greater than Q(in), while the acoustic or sonic method for determining kick relies upon determination of D(out) being less than D(in). Both of these methods require additional and complex instrumentation that may be unreliable in many cases, and is not applicable for all types of kicks and all types of drilling fluids.

The concept of the present invention does not rely upon either of the above principles. The method instead utilizes existing instrumentation, mainly the pit volume totalizer 20, with the addition of electronic data recorders 28 coupled with software within the computer 26 to handle the data and display recorded data in real time.

The technique according to the present invention utilizes thus the PVT as a flow indicator, with consideration only for flow out rather than delta flow. When the mud pumps 10 are shut down, the flow into the well and thus the flow out of the well goes to zero. The flow out of the well and thus the flow back to the pits may not necessarily go to zero instantaneously, and will not go to zero if a kick is occurring. Thus if flow continues, the level in the pits P will increase over time. The PVT thus provides an output signal indicative of when the well is flowing and, with the real time data manipulation of this signal, mud flow rate may be calculated.

Due to circumstances associated with rig piping configuration, the drilling fluid properties (thermal expansion and fluid compressibility) and the potential for wellbore breathing, any observed flow after the pumps are shut down may not necessarily indicate that a kick is occurring. It is quite common for flow to be observed after the pumps are shut down when there is no kick. This demonstrates the need for a method to correctly identify whether or not a kick is associated with the flow. According to the present invention, a baseline curve can assess all the factors contributing to a flow, with the exception of a kick. Thus a curve different than the baseline curve may indicate an actual kick, and thus the need for a corrective procedure.

The total fluid volume in the closed loop system is fixed, excluding fluid lost due to filtration into the formation and mud lost on cuttings (unless fluid is added to the system). This total volume represents the fluid volume flowing through the surface equipment (which is fixed), the fluid volume in the wellbore (which is determinable), the known volume of the mud pits, the fluid volume due to thermal expansion of the fluid and compressibility of the fluid (each of which may be calculated), the fluid volume attributable to well breathing (which may be quantified using this invention), and the influx or well kick volume which is unknown.

Since all factors contributing to flow back after the pumps are shut down, except for the kick volume, are known or can be reliably determined, e.g., by a computer receiving real time signals from the sensors, the system of the present invention allows for the reliable determination of formation fluid influx into the well based upon the flow back volumes. Moreover, information is captured in real time, i.e., the information is available to the drilling operator substantially instantaneously with the generation of the data. Relevant data may be output and reformatted into various configurations, as desired by the operator.

Figure 2:
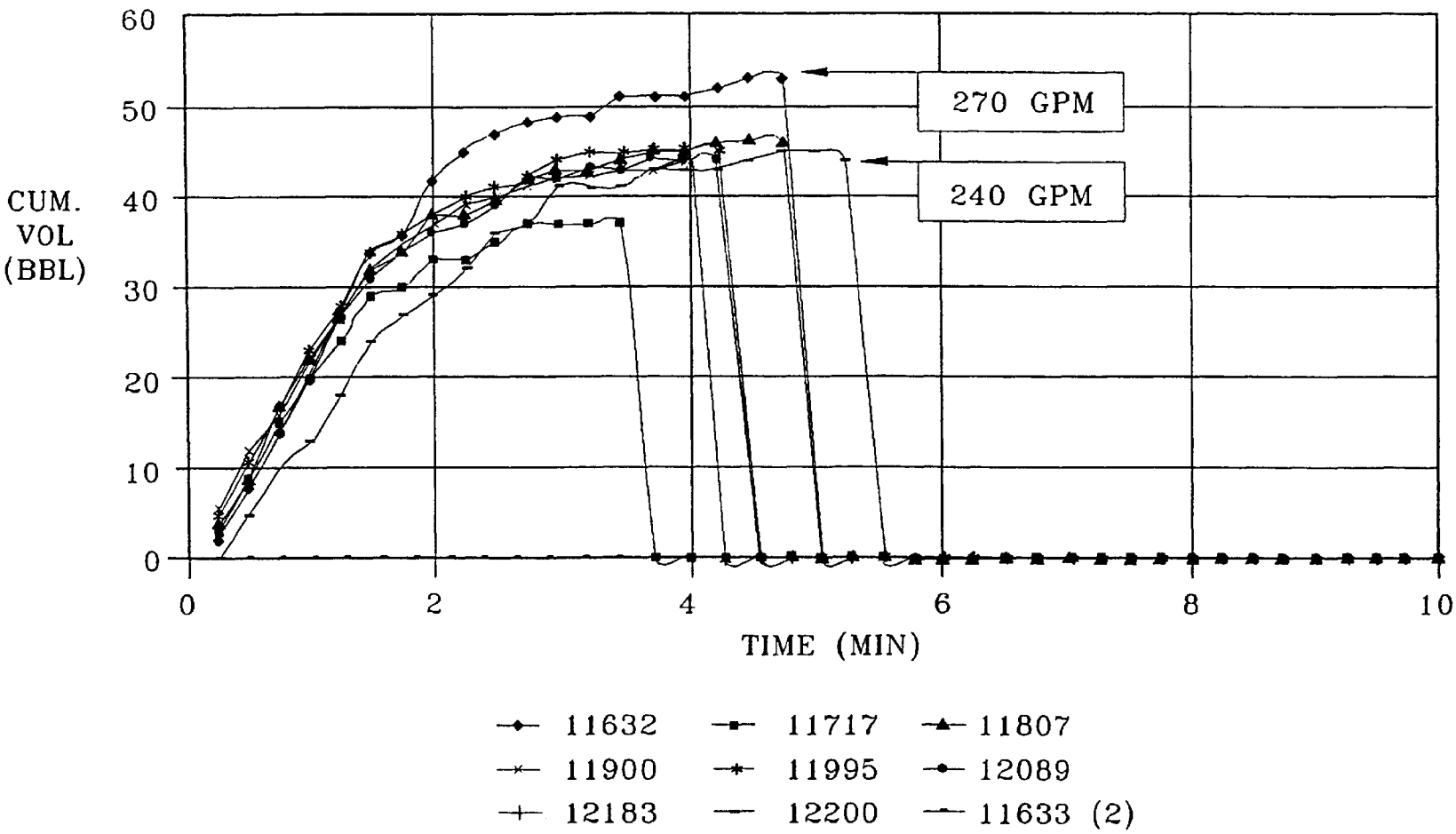
FIG. 2 is plotted data illustrating cumulative volume as a function of time under circumstances where no kick and no well breathing are occurring.
Figure 3:
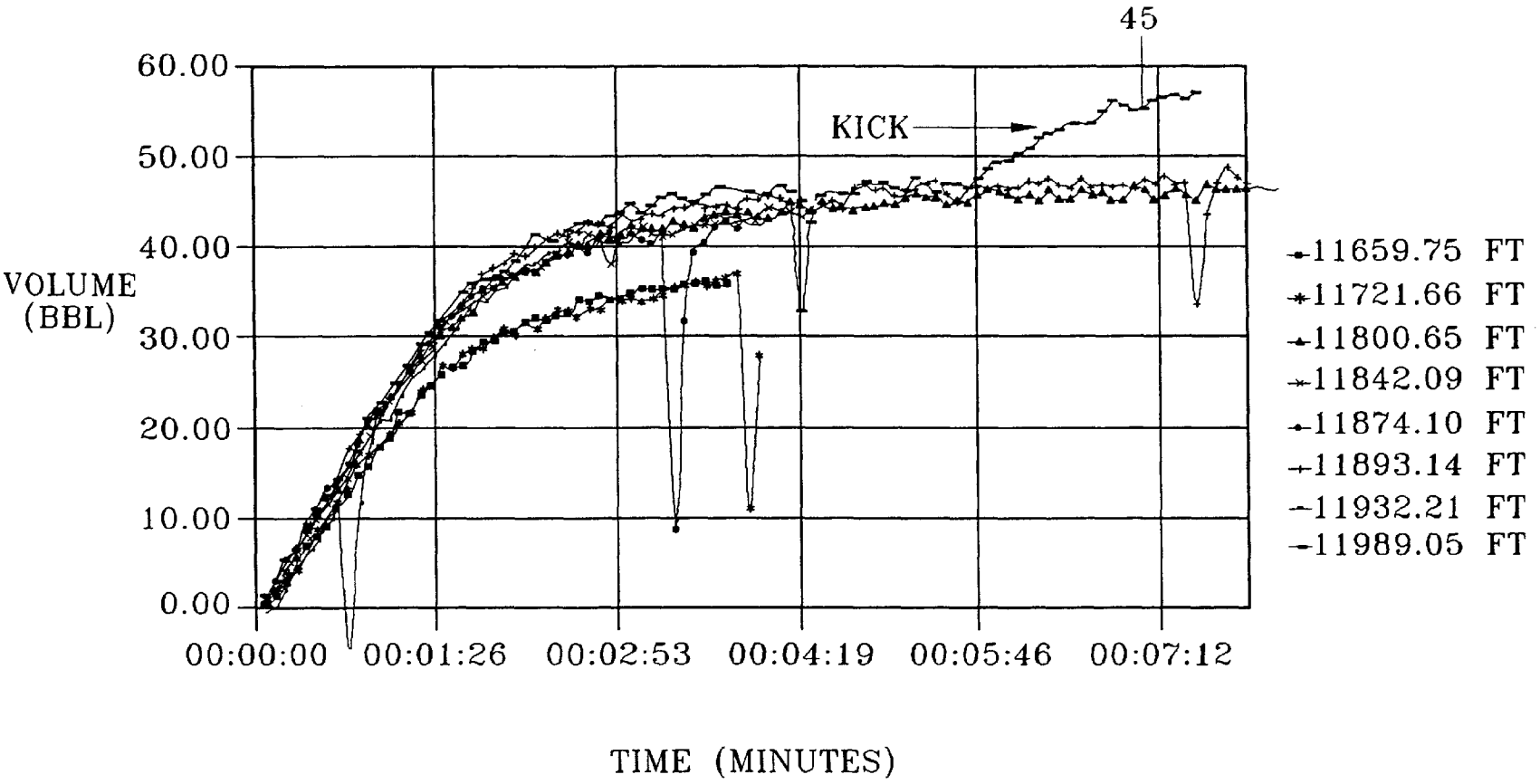
FIG. 3 is plotted data illustrating cumulative volume as a function of time under circumstances initially illustrating no kick or well breathing, then a kick with volume flow-back.

The techniques of the present invention are thus able to reliably monitor the nominal behavior of the drilling fluid. Measurements may be taken, recorded, and data may be displayed in real time and at the well site. Those skilled in the art will appreciate that automated techniques may be used for automatically taking corrective action in response to the data, if desired. Operator adjustable and/or fixed limits for various parameters may be input into the computer 26 so that, if those limits are exceeded, computer 26 may actuate an alarm 32 in response to a preestablished difference between the baseline reading and the actual measurements. The computer 26 thus may output an alarm signal if, for example, the slope of the curve as shown in FIG. 3 or the cumulative volume shown in FIG. 3 exceed a preselected value. FIG. 2 illustrates an exemplary display output according to the present invention for a stable well when no kick and no well breathing are occurring. The designations for depth to the bottom of the well are in feet. The plotted data in FIG. 2 represent cumulative fluid volume changes based on the various contributing factors (i.e., fluid volume in the surface equipment, fluid thermal expansion and fluid compressibility) to any observed flow back from the well when the pumps are shut down. The only factors contributing to these fluid volume changes are thus fixed or determinable. Utilizing this systematic approach, it is possible to quantify the information shown and thus determine if a kick occurs due to a sudden increase in the cumulative volume.

FIG. 3 does illustrate an exemplary output for a "stable" wellbore, and more positively illustrates stable flow in a well, and the occurrence of a kick. In this example, no wellbore breathing and no kick are initially indicated. The only factors initially contributing to the volume changes are the factors discussed above for the baseline data shown in FIG. 2. The occurrence of the kick occurs at the deepest point in the well, and is shown by line 45.

Figure 4:
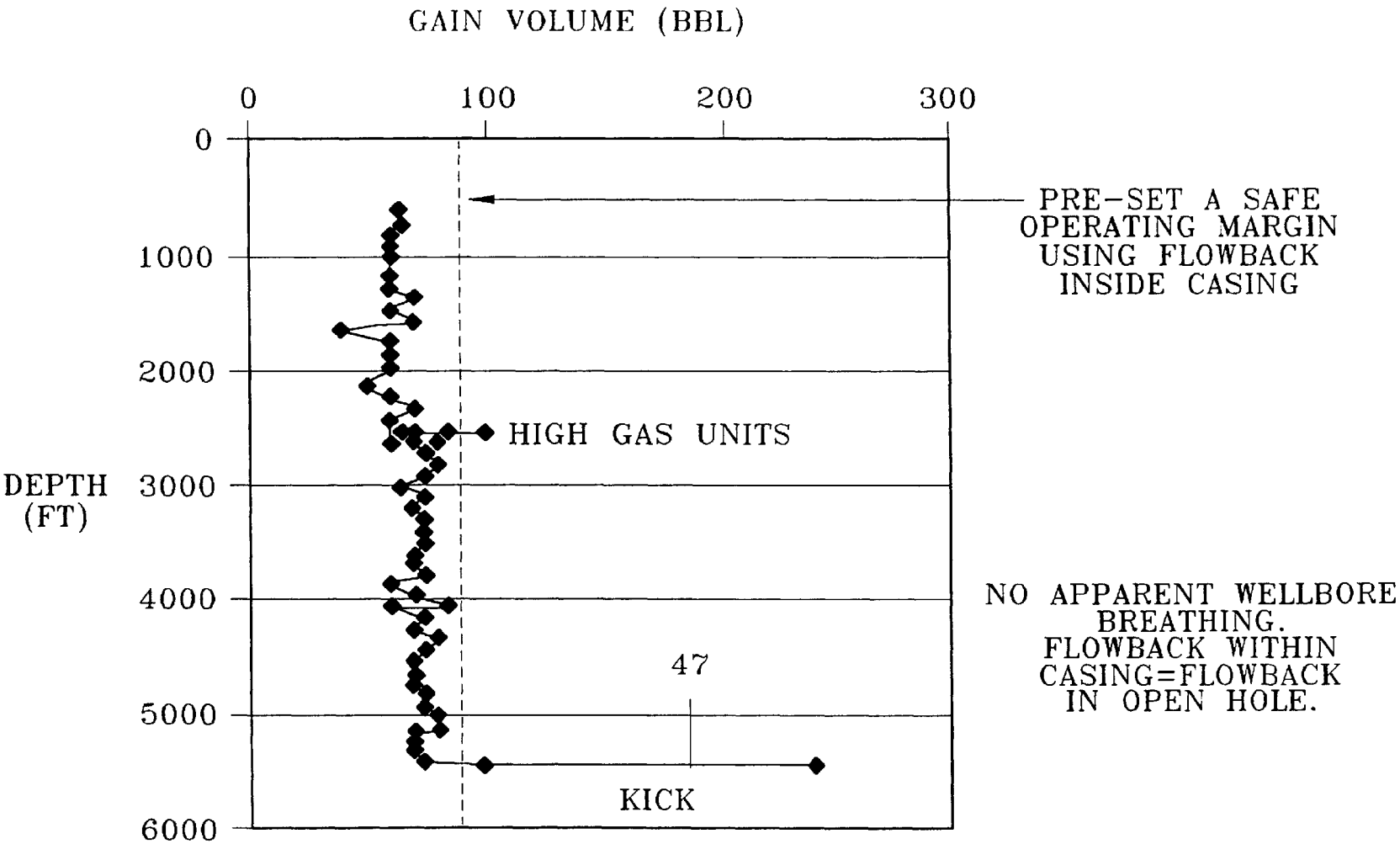
FIG. 4 is a graphical display of fluid volume as a function of depth, thereby illustrating various flow-back volumes at particular depths.

FIG. 4 illustrates the much larger volume of a kick (line47) that was allowed into the well before taking appropriate action. The safe operating margin reference line for this application was arbitrarily set at about 90 barrels. A "mini-kick" is shown at about 2500 feet. In this case, approximately 30 barrels were due to the kick, while approximately 70 barrels were associated with stable flow (total flow=70+30=100 barrels). With the system with the present invention in place, the operator could easily have shut in the well at approximately 80 barrels total, thereby resulting in only a 10 barrel kick. A much larger and more costly kick occurred at 5300 feet. The total volume was 240 barrels (80 barrels+160 barrels). Again, the operator could have taken appropriate corrective action at 90 barrels. Those skilled in the art appreciate the cost and risk associated with a 160 barrel kick. The savings as a result of promptly shutting in the well in the event of a kick may be millions of dollars.

Those skilled in the art will understand that the flow curve one would expect for a breathing well would appear to be the same as FIG. 3, but the volume would be higher. The difference between a kick and any other flow is that all the other flows are stable and will go to zero in a relatively short time. The slope of the curves on FIG. 3 may typically go to zero after 5 to 10 minutes or, with a breathing well, may be up to 30 minutes or longer. When a kick as shown in FIG. 3 occurs (line 45), the flow continuously increases, and the slope of the curve does not flatten out. Both the slope and the area under the curve are important for analysis to properly determine a kick, and thus analysis can be made and corrective action then taken either by the drilling operator and/or automatically by the computer. As an example of the data generated by the techniques of the present invention, it is to be understood that when a kick is occurring, the length of time between the start of the kick and the detection of the kick is very important. Subsequently, the volume of kick fluid taken into the wellbore is very important. Both of these are desirably minimized according to the present invention. The techniques of the present invention may thus decrease the kick volume by a factor of ten or more, and may also dramatically decrease the detection time. This new method may not necessarily achieve the desired goal of instantaneous kick detection, but the information acquired by the driller is much closer to reaching its desired goal.

Figure 5:
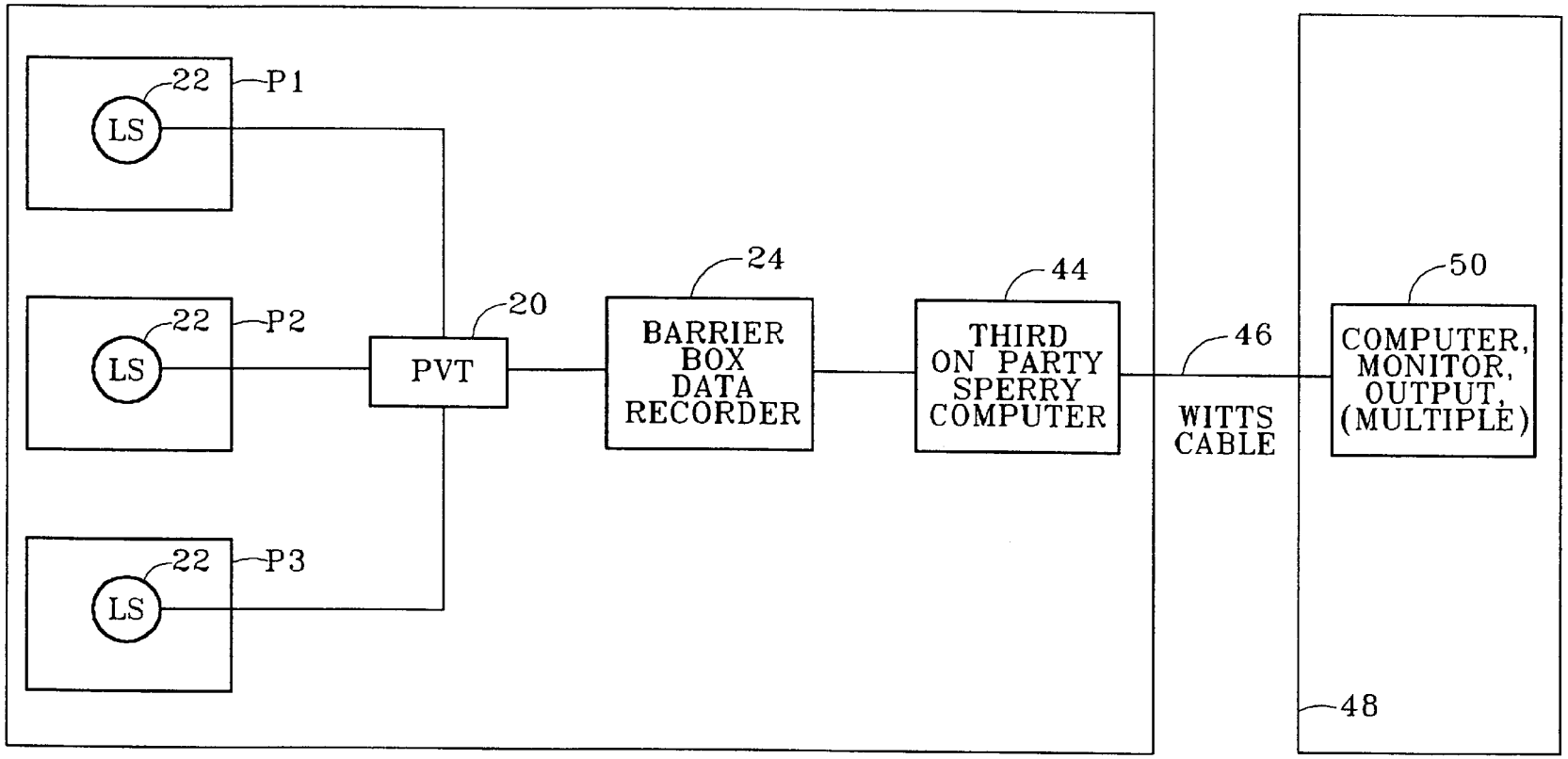
FIG. 5 is a simplified block diagram of an alternative embodiment of a real-time wellbore pit monitoring system.

FIG. 5 illustrates an alternative embodiment of a real time wellbore pit volume monitoring system according to the present invention. Unless otherwise noted, those skilled in the art will appreciate that the components as shown in FIG. 1 may also be included in the FIG. 5 embodiment. In FIG. 5, level sensors 22 output signals responsive to the volume of fluid in each of the active mud pits P1, P2, and P3. This information is input to the PVT 20 and then to the barrier box 24, as previously discussed. The information may then be input to a third party computer 44, i.e., computer provided either by the service company which provides the monitoring service or by another party. Information from the computer 44 may be transferred by a Wellsite Information Transfer Specifications cable 46, or other data transfer system, to computer 34 located at a facility 48 remote from the wellsite. That remote location may also include another computer, various monitors, and various permanent storage devices, collectively referred to as assembly 50. Equipment 50 may thus be similar to the equipment 26, 28, and 30 as shown in FIG. 1, and may be provided either at the well site or at a remote location. The system as shown in FIG. 5 simplifies the procedure for the service company providing the monitoring service by connecting to a preexisting system. A simplified version of computer software may be provided in the computer 44, with the final diagnosis of the data being prepared by the equipment 50. Those skilled in the art will appreciate that various data transmission devices other than the cable 46 may be used to transmit data from the wellsite to a computer and monitoring assembly 50 located either at the wellsite or at a location remote from the wellsite.

Prior to drilling into exposed formation (at the commencement of the interval), the baseline for the system method may be generated. When drilling through the cement at the bottom of the well which has been put in place when cementing the last string of casing, the pumps may be shut down and the flow-back profile recorded. This is the PVT versus time curve whereby time zero is the instant the pumps are shutdown and at this instant the PVT is arbitrarily also set at zero. The fluid in the wellbore is contained within a known and controlled space, with no possibility of wellbore breathing or a formation fluid influx contributing to the recorded flow-back profile. This curve becomes the baseline upon which future determinations of a stable wellbore may be based. The flow-back profile for the baseline rep When drilling the interval, if this level is exceeded, the well may be determined to be unstable.

Figure 6:
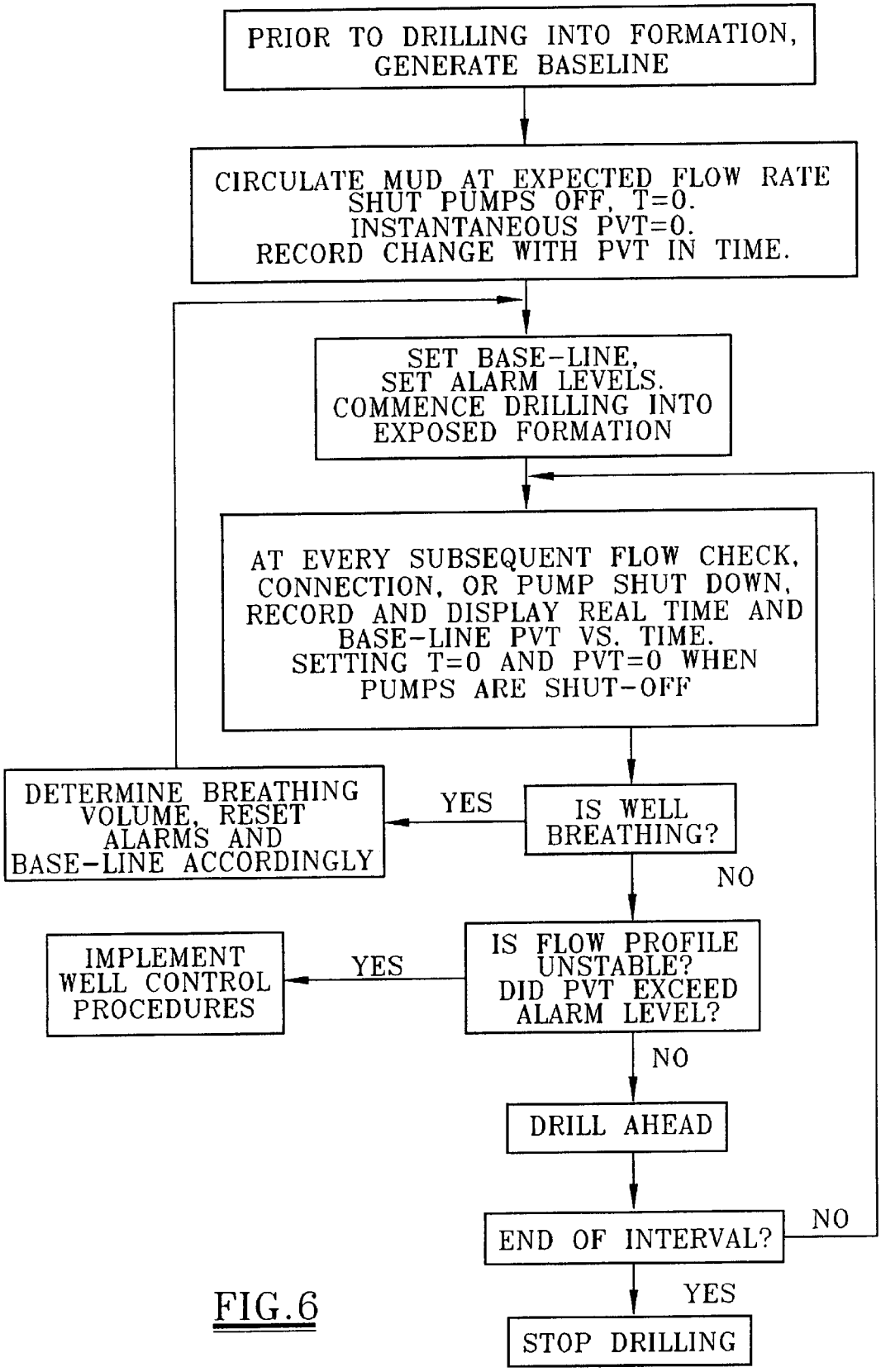
FIG. 6 is a flow chart of the software process which may be used to monitor pit volume according to the present invention.

Once formation rock is exposed, the system of the present invention may be used to establish if either or both of wellbore breathing and formation fluid influx (kick) are occurring. At every flow check, connection of drill pipe, or drilling fluid pump shut down, recorded time may be set at zero, as may be the instantaneous PVT level, and the flow out of the well may be monitored and recorded in real time using the PVT data. The base-line most preferably is displayed together with the real time flow back profile. Should wellbore breathing be identified, the volume associated with the breathing may be determined and the pre-set alarm levels may be adjusted and the base-line thus re-set. If a kick is indicated or suspected, well control procedures may be implemented. If the well is stable, drilling may commence. A flow chart of the software process used to monitor pit volume is shown in FIG. 6.

The present invention is thus well adapted to carry out the objectives and attain the features and advantages mentioned, as well as others inherent therein. While the present invention has been depicted, described, and is defined by reference to particular preferred embodiments of the invention, such references do not imply a limitation on the invention, and no such limitation is to be inferred. The inventions is capable of considerable modification, alternation, and equivalents in form and function, as will occur to those ordinarily skilled in the pertinent arts. The depicted and described preferred embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A system which monitors wellbore fluid volume changes as an indication of a wellbore kick and/or wellbore breathing, the wellbore fluid being pumped in a closed loop between one or more surfaces pits at a wellsite and a wellbore, the fluid monitoring system comprising:

a fluid level sensor associated with each of the one or more pits for sensing the fluid level in the one or more pits under substantially fluid static conditions when wellbore fluid is not being pumped to or from the one or more pits;

a computer for receiving signals from the one or more fluid levels sensor; and one or more signal receiving devices for receiving signals from the computer indicative of variations in the closed loop fluid volume as a function of time to provide an indication of wellbore kick and/or wellbore breathing.

2. The system as defined in claim 1, further comprising:

a fluid temperature sensor positioned along the closed loop for sensing the fluid temperature in the closed loop;

a fluid density sensor positioned along the closed loop for sensing the fluid density in the closed loop; and the computer receives signals from the fluid temperature sensor and the fluid density sensor.

3. The system as defined in claim 1, further comprising;

the one or more pits comprise at least first and second surface pits;

a pit volume totalizer for receiving fluid level signals from each of first and second level sensors associated with the respective first and second pits, the pit volume totalizer summing the output from the first and second level sensors to monitor the cumulative volume of fluid in the first and second pits.

4. The system as defined in claim 3, further comprising:

a data transmission unit for transmitting data from the pit volume totalizer to the computer, the computer being located remote from the wellbore site.

5. The system as defined in claim 3, further comprising:

a signal converter for receiving signals from the pit volume totalizer and outputting signals to the computer.

6. The system as defined in claim 1, wherein each of the computer and the one or more signal receiving devices are located at the wellbore site.

7. The system as defined in claim 6, wherein the one or more signal receiving devices comprise a plurality of monitors for displaying in real-time the cumulative fluid volume changes in the closed loop as a function of time.

8. The system as defined in claim 1, further comprising:

an alarm responsive to the computer for alerting an operator of an unexpected increase in the monitored volume of the fluid closed loop.

9. The system as defined in claim 1, wherein the computer automatically generates an alarm signal based on at least one of the rate of change of the monitored fluid volume and cumulative volume relative to a baseline.

10. The system as defined in claim 1, wherein the computer compares the signals with baseline data generated at the start of each drilling interval.

11. The system as defined in claim 1, wherein the one or more signal receiving devices comprises:

a data recordation device for maintaining a permanent record of the fluid volume changes in the closed loop as a function of time.

12. The system as defined in claim 1, wherein the computer outputs signals indicative of fluid volume changes as a function of wellbore depth.

13. A method which monitors the fluid volume changes in a closed loop fluid system extending between one or more surfaces pits at wellsite and the wellbore to provide an indication of a wellbore kick and/or wellbore breathing, the method comprising:

sensing the volume of fluid in each of the one or more pits under substantially fluid static conditions when wellbore fluid is not being pumped to or from the one or more pits;

in response to signals representative of the fluid volume, determining changes in the fluid volume;

outputting indications of determined changes in the fluid volume as a function of time; and initiating corrective action to minimize formation fluid influxes and/or drilling fluid losses in response to the determined changes.

14. The method as defined in claim 13, further comprising:

sensing the temperature of the fluid in the closed loop fluid system; and sensing the pressure of the fluid in the closed loop fluid system.

15. The method as defined in claim 13, further comprising:

the closed loop system including at least first and second fluid storage pits; and sensing the volume of fluid includes monitoring the fluid level in each of the first and second fluid storage pits; and summing the indications of the fluid volume for each of the first and second pits.

16. The method as defined in claim 13, further comprising:

transmitting indication of changes in the fluid volume to a computer located remote from the wellbore site.

17. The method as defined in claim 13, wherein signals indicative of the determined changes in the fluid volume are output to an operator at the wellbore site.

18. The method as defined in claim 13, further comprising:

actuating an alarm in response to an unexpected increase in the fluid volume changes as a function of time.

19. The method as defined in claim 13, further comprising:

displaying changes in the determined fluid volume as a function of time on one or more monitors.

20. The method as defined in claim 19, wherein each of the one or more monitors is located at the wellbore site.

21. The method as defined in claim 13, further comprising:

transmitting indications of fluid volume changes from the wellbore site to a remote location; and outputting indications of the volume changes as a function of time at the remote location.

22. The method as defined in claim 13, further comprising:

generating a permanent record of the fluid volume changes as a function of time.

23. The method as defined in claim 13, further comprising:

displaying indications of fluid changes as a function of the wellbore depth.

24. The method as defined in claim 13, further comprising:

generating baseline data at the start of each drilling interval; and comparing the output indications to the baseline data in real time.

* * * * *